US005810119A

United States Patent [19]

Koshak

[11] Patent Number: 5,810,119

[45] Date of Patent: Sep. 22, 1998

[54] JACK ARRESTOR

[76] Inventor: John W. Koshak, 67 Windrush Ln., Barrington Hills, Ill. 60010

[21] Appl. No.: 665

[22] Filed: Dec. 30, 1997

[51] Int. Cl.[6] ..... B66B 9/04

[52] U.S. Cl. ..... 187/272; 92/24

[58] Field of Search ..... 187/207, 272, 187/275, 414; 188/67, 170, 84; 92/24, 27

[56] References Cited

U.S. PATENT DOCUMENTS 4,449,615 5/1984 Beath et al. ..... 187/207

*Primary Examiner*—Kenneth Noland
*Attorney, Agent, or Firm*—Gregory Scott Smith; James J. Leary; Carol D. Titus

[57] ABSTRACT

A safety brake device (1) for hydraulic elevators acts by arresting the axial movement of the elevator ram (3) with respect to the main hydraulic cylinder (5) of the elevator. The safety brake (1) utilizes two lever acting brake arms (27) lined with an accretable metal (31), for example annealed copper, as the friction material. When actuated, the brake arms (27) contact the ram (3) circumferentially to slow and stop the falling ram. The lining material (31) is machined inside the brake arms (27) to a diameter slightly less than the diameter of the ram (3) and when actuated, the accretable material (31) on the brake arms (27) contacts the ram (3) with sufficient frictional force to stop the downward motion of the ram (3). The safety brake (1) may be actuated by loss of hydraulic pressure, by an electronic signal from a hydraulic pressure detector, by down overspeed or by an uncontrolled down motion detector. In the case of the hydraulic pressure loss, reapplication of normal pressure in the hydraulic cylinder (5) will automatically reset the brake (1). The safety brake device (1) can also be configured for use as a safety brake on other hydraulic or pneumatic cylinders or for use as a safety brake on cable-actuated traction elevators.

11 Claims, 8 Drawing Sheets

JACK ARRESTOR

CROSS REFERENCE TO RELATED APPLICATIONS

The present invention is a continuation application of International Application Number PCT/US96/15901, filed Oct. 4, 1996, "Elevator Stopping Device," which claims as a priority date the Oct. 6, 1995 filing date of the U.S. patent application Ser. No. 08/540,323. The present application is further related to the subject matter of co-pending U.S. patent application Ser. No. 08/832,327, filed Mar. 26, 1997, "Hydraulic Brake Controller", which is a continuation-in-part of U.S. patent application Ser. No. 08/540,323, filed Oct. 6, 1995, "Jack Arrestor;" and co-pending U.S. patent application Ser. No. 08/857,617, filed May 16, 1997, "Jack Arrestor," which is a continuation of the U.S. patent application Ser. No. 08/540,323.

FIELD OF THE INVENTION

The present invention relates generally to safety brakes for hydraulic jacks or rams. In particular, the present invention relates to a hydraulic ram lifting elevator emergency arrestor using a lever and lock mechanism to provide braking action without permanently damaging or destroying the hydraulic ram.

BACKGROUND OF THE INVENTION

The present invention relates to a hydraulic ram arrestor using a lever lock type of mechanism which is activated by a pressure failure condition, down overspeed, or uncontrolled down motion. When activated, two lever acting brake arms are dropped into contact with the elevator ram, the resulting friction bringing the elevator to a sliding stop.

There have been numerous brake systems developed for stopping hydraulic ram elevators during emergency situations. All of the prior art patents found were directed toward collets or brake shoes, that, during a hydraulic pressure failure, would drop down and wedge in between a fixed housing and the ram of the elevator. The friction generated by the downward motion of the ram in contact with the collet or brake shoe causes the collet or brake shoe to be driven downwardly, thereby wedging the ram to a halt. Empirical evidence indicates that the force necessary to stop an elevator using such a brake exceeds the elastic limit of the material used in commercial rams causing the ram to be permanently deformed into an hourglass shape at the point where such brakes grip the ram. The prior art elevator safety brakes have no positive stop to limit the deformation to the elevator ram caused by the braking mechanism. This type of damage to the ram cannot be repaired and instead, expensive and time consuming replacement is required to restore the elevator to working condition. The prior art patents also disclosed elevator brakes that have many moving parts, and are correspondingly complex. Additionally, the prior art devices appear relatively large and bulky. Size is an important consideration because there is often limited space into which to fit a braking device. Therefore, it is desirable for the brake to have a low profile, thereby facilitating installation in all present hydraulic elevators.

As a specific example of a prior art design having the above mentioned short comings, Beath et al., U.S. Pat. No. 4,449,615 is a floor mounted lever-actuated wedge device. The many components in this design complicate it by comparison to the present invention. Beath uses collets, that, during a hydraulic pressure failure, drop down and wedge in between a fixed housing and the ram of the elevator. The friction generated by the downward motion of the ram in contact with the collets causes the collets to be driven downward, thereby wedging the ram to a halt. The force necessary to stop an elevator using the brake disclosed in Beath exceeds the elastic limit of the material used in commercial rams causing the ram to be permanently deformed into an hourglass shape at the point where the collets grip the ram. Additionally, the above mentioned patent does not precisely show relation to the top of the cylinder and the bottom of the elevator. However, it appears too tall to fit most existing elevator systems.

In light of the problems listed above and exemplified by U.S. Pat. No. 4,449,615, a new elevator brake is needed that can safely stop a fully loaded elevator without permanently damaging the ram.

SUMMARY OF THE INVENTION

The general object of the present invention is to provide a mechanism for arresting an elevator which can safely stop a fully loaded elevator without permanently damaging any part of the elevator.

It is another object of the present invention to provide an elevator arrestor that allows the elevator to be usable within a short period of time with little reset and repair necessary. Optimally, the reset and repair should be a relatively simple and inexpensive procedure.

It is a further object of the present invention to provide an arrestor that will fit within a small vertical space such that it can fit within the normal design parameters for hydraulic ram elevators, and may also be retrofit into existing hydraulic ram elevators.

It is yet another object of the present invention to provide a system that can be easily installed and requires very little down time in which the elevator is non-functional.

It is an additional object of the present invention to provide for an arresting system that is inexpensive to manufacture.

The present invention is a hydraulic safety arrestor for slowing and stopping a ram, jack or other cylinder type object. It utilizes two lever acting brake arms lined with an accretable metal as the friction material. When actuated, the brake arms contact the ram circumferentially and press the friction material against the surface of the ram to slow and stop the falling ram. The lining material is machined inside the brake arms to a diameter slightly less than the diameter of the ram. When actuated, the lining material contacts the ram with sufficient frictional force to stop the downward motion of the ram without permanent deformation of the ram. The force applied to the surface of the ram by the brake arms causes a temporary hourglass deformation of the ram which greatly augments the friction force to retard the falling ram. The geometry of the braking mechanism limits the deformation to well within the elastic limit of the ram material to prevent any permanent deformation to the ram. The rest of the mechanism is comprised of side buttress members, pivot pins, and a base plate, mounted above a spacer ring. The spacer ring is the same diameter as the cylinder and is variable in length to raise the base plate and brake assembly above any bolts or other existing projections. Eyelets are welded to the existing cylinder to provide for secure mounting and correct alignment and realignment when the brake is removed and reinstalled.

The brake arms may be actuated mechanically by loss of hydraulic pressure, by an electronic signal from a hydraulic pressure detector, by down overspeed or by an uncontrolled down motion detector.

The force applied by the braking action is transferred from the brake arms through the base plate and spacer ring onto the circumferential area of the top of the main cylinder and any associated support structures. By monitoring the pressure and overspeed, the fall of the elevator can be limited to speeds with a maximum of less than twice the normal down speed, thus limiting the kinetic energy produced, by not allowing a free falling elevator. Therefore, the pit structure would absorb the energy without damage or deformation, without any modifications to the pit structure.

The present invention, using an accretable metal or other adherent material to apply a braking force to the ram is a clear improvement over the prior art. Prototype testing has shown that copper bar formed to shape has yielded sufficiently high braking force, with and without the presence of oil on the surface of the ram. Several materials have been tested, and, to date, copper has been the best material for the purpose. The present invention is also comparatively simple and low in profile facilitating installation on current elevator designs.

These and other objects and advantages of the invention will no doubt occur to those skilled in the art upon reading and understanding the following detailed description along with the accompanying drawings.

DETAILED DESCRIPTION OF THE INVENTION

The drawings show a safety brake system according to the present invention, indicated generally by the reference number 1. Although the brake system 1 is applicable to many hydraulic ram or piston devices, it is described here in its preferred use on a hydraulic ram lifting elevator. References to "up", "down", "vertical", "horizontal", etc. should be understood to refer generally to the relative positions of the components of the illustrated device, which could be otherwise oriented or positioned for non-elevator applications. Although the term "hydraulic" is used, references to "hydraulic" should be understood to refer generally to any pressure ram device with a main cylinder which surrounds a second, axially-moving cylinder or ram, including but not limited to hydraulic and pneumatic ram devices. In addition, the present invention can be used as a brake on any linear motion device with an axially-moving compression or tensile member.

Figure 1:
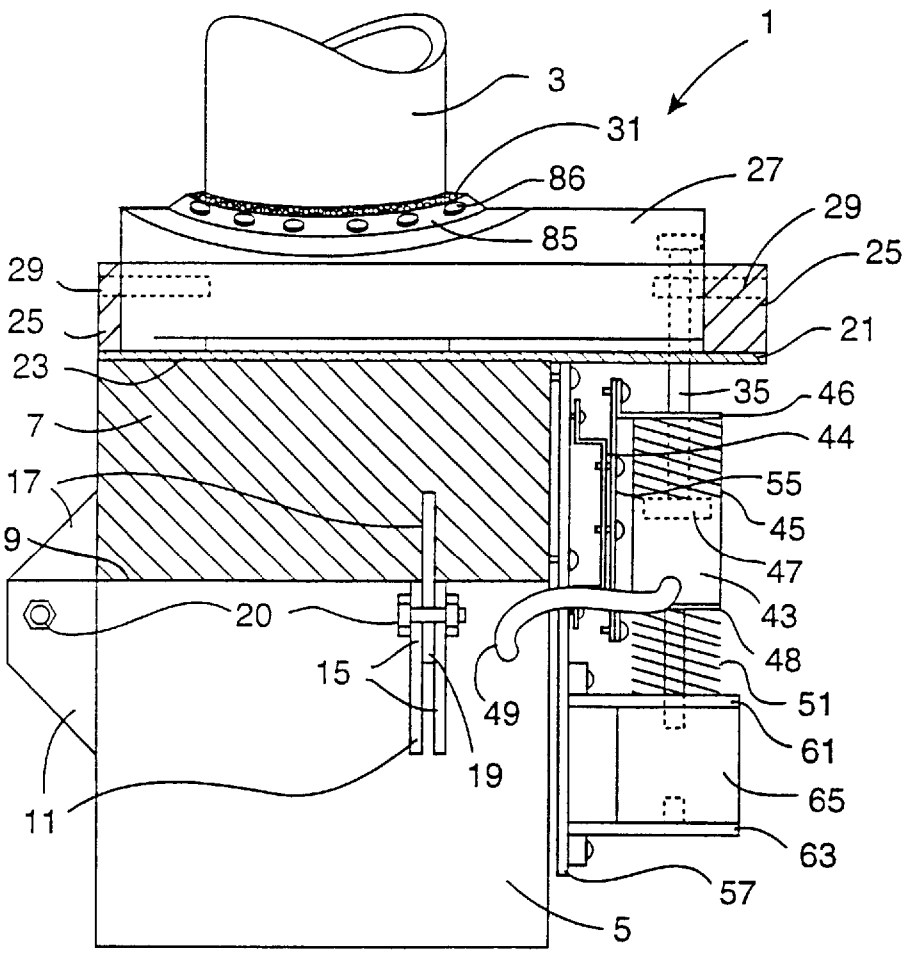
FIG. 1 is a side elevation view showing the brake and control components according to the invention.

In FIG. 1, a reciprocating piston or ram 3 is shown with brake system 1 installed on the existing main cylinder 5 of a hydraulic elevator. The ram 3 of a hydraulic elevator is typically a hollow steel cylinder with a smoothly ground exterior surface. The external diameter of a hydraulic elevator ram 3 is typically in the range of approximately 3.5 inches to 8 inches, although some hydraulic elevator rams are as large as 15 inches in diameter. The wall thickness of the hydraulic elevator ram 3 is nominally 0.250 inches, with a range from approximately 0.188 inches to approximately 0.375 inches, depending on the external diameter of the ram 3. Spacer ring 7 rests upon the upper end of main cylinder 5 at 9 and is removably fixed to upper end of main cylinder 5 by any one of a number of known fastening means. In a preferred embodiment, the known fastening means comprises eyelets 11 fixed to the outside surface of main cylinder 5 and near the upper end 9 of main cylinder 5. Each eyelet comprises a pair of flanges 15 spaced a short distance apart, and flanges 17 on spacer ring 7 fit in between flanges 15 of eyelets 11. Flanges 17 and flanges 15 have bolt holes 19 which are aligned to accept eyelet bolts 20 to fix spacer ring 7 to main cylinder 5. In an alternate embodiment, eyelets 11 may comprise only a single flange. The advantage of using eyelets 11 is that any one of eyelets 11 can act as a pivot to rotate brake system 1 away from main cylinder 5 to allow access for servicing when eyelet bolts 20 are removed from the other eyelets 11. Removal of all eyelet bolts would allow total removal of brake system 1 for major work. Eyelets 11 also allow for exact reattachment of the device assuring proper alignment. Base plate 21 is fixed to the upper surface of spacer ring 7 at 23. Side buttress members 25 are fixed to base plate 21 on either side of brake arms 27. In the preferred embodiment, brake arms 27 are hingably fixed to side buttress members 25 by pivot bolts 29 allowing brake arms 27 to rotate into or out of contact with ram 3.

Figure 2:
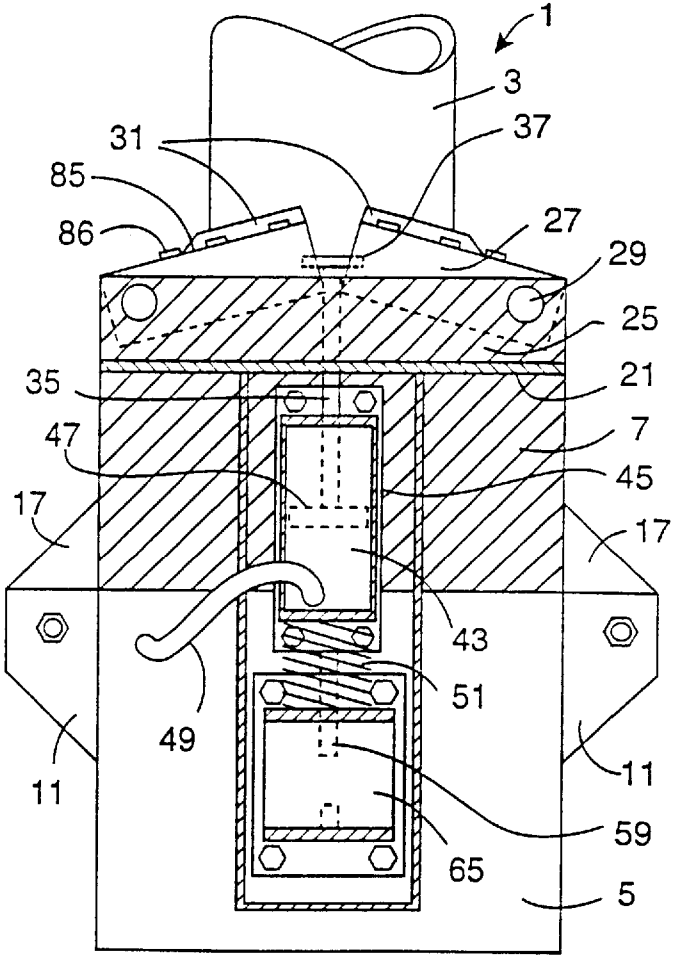
FIG. 2 is the front elevation view showing the brake and control components according to the invention.

When the hydraulic elevator safety brake is in the ready or standby position, as shown in FIG. 2, brake arms 27 are raised approximately 15 degrees from horizontal, allowing travel clearance for ram 3. Brake arms 27 are shaped having semicircular cut-outs 26, which are best seen in plan view in FIG. 4, of diameter slightly larger than ram 3, and having a friction material mounting surface 28 on the inside of cutouts 26. An accretable friction material 31 is fixed to the friction material mounting surfaces 28 of semicircular cut-outs 26 of brake arms 27. The accretable friction material 31 rests on a small shelf or ledge 67 which extends from the friction material mounting surface 28 on the inside of cutouts 26, as seen in cross section in FIG. 3. In one particularly preferred embodiment of the invention, the ledge 67 and the friction material mounting surface 28 are machined into semicircular inserts 85 which are bolted 86 into the semicircular cut-outs 26 of brake arms 27. This arrangement simplifies the machining operations of the brake arms 27 and provides an easy means for replacing the friction material 31 in the field. An accretable friction material is a material which causes friction by adhesion of the friction material to the moving surface which it contacts. The braking mechanism may also involve actual material transfer or "accretion" of the accretable friction material onto the moving surface. In a preferred embodiment the accretable material 31 is annealed copper, but other materials may be used. Annealed copper is preferred because, of all the materials tested, it has the greatest tendency to adhere to the ram 3. This maximizes the amount of friction between the ram 3 and the brake lining 31, which creates the greatest braking force with the least amount of damage/deformation of the ram 3 and the braking system 1. The inside diameter of the accretable friction material 31 is slightly smaller than the outside diameter of the ram 3. This provides proper frictional engagement with ram 3 to bring the elevator to a halt.

Figure 3:
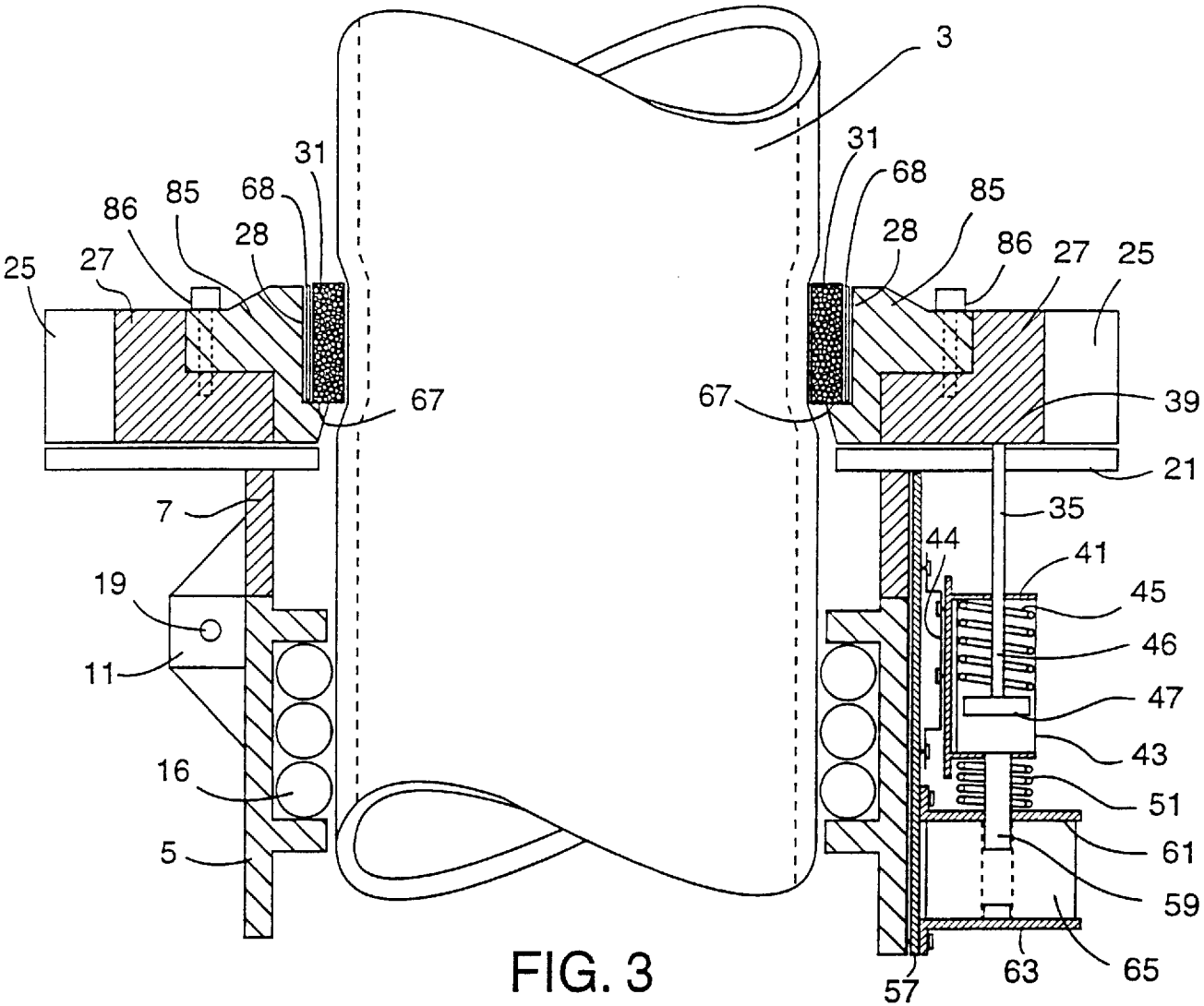
FIG. 3 is a sectional view showing the frictional contact, and locations of the packing in relation to the invention, as viewed along the line 3—3 in FIG. 4.
Figure 4:
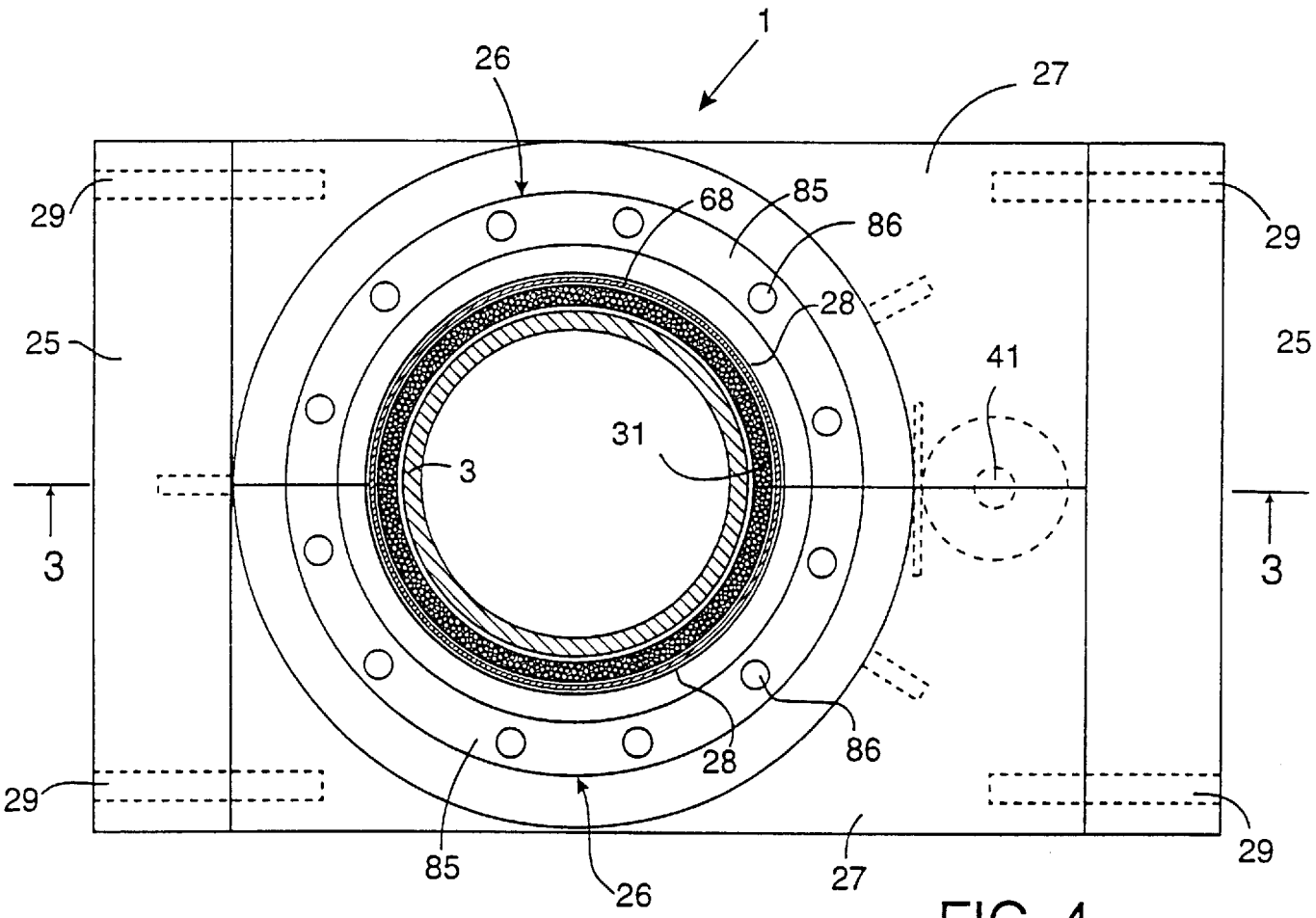
FIG. 4 is a plan view of the invention.

FIG. 3 shows the brake system 1 in the actuated position with the brake arms 27 approximately perpendicular to the surface of the ram 3 and the accretable friction material 31 in circumferential contact with the ram 3. Further travel downward by brake arms 27 is prevented by contact with base plate 21. Spacer ring 7 transfers the braking force from the brake arms 27 and base plate 21 onto the main cylinder 5 or any associated support structure which may exist. Eyelets 11 and the structural strength of spacer ring 7 prevent brake system 1 from slipping and assure equal transfer of force directly downward, into existing main cylinder 5 or onto any associated cylinder support structures. Kinetic energies can be limited by limiting the down speed allowed before brake system 1 is actuated, thereby preventing damage to the brake system 1, ram 3 or to the main cylinder 5.

The braking force from the hydraulic elevator safety brake is provided by two cooperative braking mechanisms. The primary braking mechanism is from the frictional force between the friction material 31 and the surface of the ram 3. This frictional force is maximized by the use of an accretable friction material 31, such as annealed copper. The frictional force between the accretable friction material 31 and the surface of the ram 3 is further augmented by a second braking mechanism. When the brake arms 27 are in the actuated position, as shown in FIG. 3, the interference fit between the inner diameter of the friction material 31 which forms the braking surface and the outer diameter of the ram 3 causes a temporary hourglass deformation of the ram 3. This elastic deformation of the ram 3 as it passes between the actuated brake arms 27 absorbs much of the kinetic energy of the falling elevator, helping to safely bring the elevator to a stop. This secondary braking mechanism, which greatly augments the frictional force of the braking system, is particularly important in situations where the elevator ram 3 or the friction material 31 becomes contaminated with hydraulic fluid or lubricating oil, interfering with the primary frictional braking mechanism. Unlike the collet-type elevator safety brakes of the prior art, the geometry of the brake arms 27 in the present invention limits the deformation to well within the elastic limit of the ram material to prevent any permanent deformation to the ram 3. The hourglass deformation of the ram 3 has been exaggerated in FIG. 3 for illustrative purposes. Testing of the braking system has shown that an interference fit of approximately 0.010 inches to approximately 0.020 inches between the inner diameter of the braking surface of the friction material 31 and the outer diameter of the ram 3 in the actuated position is sufficient to reliably stop a loaded elevator weighing from 4,000 to 12,000 pounds, even when the ram 3 is contaminated with hydraulic fluid or lubricating oil.

To account for variations in manufacturing tolerances or for wear of the friction material 31, shims 68 may be added between the friction material mounting surfaces 28 and the friction material 31 to adjust the interference fit. Shims 68 of this sort may be used in the field at the time of installation or during periodic maintenance for adjusting the stopping force of the braking system. For safety reasons, it is preferable that the elevator safety brake bring the elevator car to a stop with a deceleration of approximately 0.5 to 1.0 g's. Knowing the top speed of the elevator, the corresponding braking distance can be calculated. For example, for an elevator with a top speed of 200 feet per minute, a 0.5 to 1.0 g deceleration would correspond to a stopping distance between approximately 4.2 and 2.1 inches. By trial and error, the elevator installer or adjuster adds shims until the braking system stops a loaded elevator with a braking distance within the calculated range.

In the preferred embodiment, brake system 1 is actuated by loss of hydraulic pressure detected by direct feedback from the main cylinder 5, by an electronic signal indicating loss of pressure in the cylinder 5, by electronic signal from a down overspeed, or by an uncontrolled down motion detector. Brake system 1 is actuated by downward motion of actuation rod 35 attached to the actuation assembly, generally identified by 33. The top of the actuation rod 35 has a circular or rectangular shaped metal wafer 37 that is received inside shaped hollows or routs 39 in the brake arms 27. This assures registration between both brake arms 27.

Hydraulic actuation of brake arms 27 is accomplished by the hydraulic actuation assembly, generally referenced by the number 38. The hydraulic actuation assembly 38 is located in and around feedback control cylinder 43 which is fixed between upper hydraulic cylinder bracket arm 46 and lower hydraulic cylinder bracket arm 48 of hydraulic cylinder bracket 55, both bracket arms 46, 48 being fixed to hydraulic cylinder bracket 55. The hydraulic actuation assembly 38 comprises feedback cylinder 43 having portal 41 to receive the lower end 46 of actuation rod 35, plunger 47 fixed to the lower end 46 of actuation rod 47, and helical compression spring 45 which is engaged over and around the lower end 47 of actuation rod 35, one end of compression spring 45 engaging the inside surface of the top of feedback cylinder 43 and the other end engaging plunger 47. Helical compression return spring 45 urges plunger 47, and actuation rod 35 fixed thereto, downward. Under normal conditions, hydraulic pressure in feedback cylinder 43, in fluid communication with main cylinder 5, overcomes the compressed spring energy of return spring 45, urging plunger 47 upward, which in turn urges control rod 35 upward, which then urges brake arms 27 into ready or standby position.

Loss of hydraulic pressure in the main cylinder 5, is communicated to feedback cylinder 43 through hose 49 (FIGS. 1 and 2). Return spring 45 overcomes the reduced pressure in feedback cylinder 43 urging plunger 47 and attached actuation rod 35 downward pulling brake arms 27 into contact with ram 3. Friction resulting from contact of accretable material 31 on the friction material mounting surface 28 of brake arms 27 urges brake arms 27 further downward into contact with ram 3 until brake arms 27 rest on horizontal base plate 21. The accretable friction material 31 on brake arms 27 grips ram 3 with sufficient frictional force to stop the downward motion of ram 3.

Electronic actuation of brake arms 27 is accomplished by the electronic control assembly generally referenced by the number 40 comprising control bracket 57 fixed to spacer ring 7, upper solenoid bracket arm 61, and lower solenoid bracket arm 63, both being fixed to control bracket 57. Electronic actuation assembly 40 further comprises, electronic activator rod 59, and helical compression support spring 51 placed over and around electronic actuation control rod 59, the upper end of support spring 51 engaging lower surface of hydraulic control assembly 38, and the lower end of support spring 51 engaging the upper surface 51 of solenoid bracket 61.

In the preferred embodiment, electronic activator rod 59 is fixed at its upper end, generally, to the hydraulic actuation assembly 38, which is slidably engaged with slide bracket 44, slide bracket 44 being fixed to control bracket 57. Solenoid helical compression support spring 51, is selected to support the weight of brake arms 27 and hydraulic actuation assembly 38. Tubular solenoid 65 is fixed between upper and lower solenoid bracket arms 61 and 63. The lower end of electronic actuation rod 59 partially penetrates tubular solenoid 65. The upper end of electronic actuation rod 59 is coupled to the underside of lower hydraulic cylinder bracket arm 48 of hydraulic cylinder bracket 55. An electronic signal from a down overspeed detector or uncontrolled downward motion detector, not shown, causes an electric current in solenoid 65 generating a magnetic field of strength sufficient to urge electronic actuation rod 59 downward into tubular solenoid 65, thereby pulling the entire hydraulic actuation assembly 38, slidably engaged to slide bracket 44, downward thereby actuating brake arms 31.

In an alternate embodiment, the electrical actuation assembly 40 can be used to actuate the hydraulic elevator safety brake directly without inclusion of the hydraulic actuation assembly 38. In this alternate embodiment, the electrical actuation assembly 40, which is otherwise the same as described above, has the electronic actuation rod 59 engaged directly with brake arms 27. To replace the function of the hydraulic actuation assembly 38 in this embodiment, an electronic signal from a hydraulic pressure detector within the main cylinder 5 could also be used to actuate the electronic actuation assembly 40, in addition to a down overspeed or uncontrolled downward motion detector.

A variety of known down overspeed or uncontrolled downward motion detectors are available for use with this invention. For example, devices such as those disclosed in Coy, U.S. Pat. No. 4,638,888 which discloses an electronic system for detecting the hydraulic pressure in an elevator ram piston cylinder, and Ericson, U.S. Pat. No. 5,052,523 and Sobat, U.S. Pat. No. 3,942,607, which both disclose mechanical means for detecting the downward speed of an elevator. The specifications of these patents are hereby incorporated by reference in their entirety.

Given the generally small distance from the bottom of a standard hydraulic lift elevator to the top of the existing piston cylinder structure, a low profile device is desirable. The present device, in ready position is between four and five inches high. This is accomplished by keeping the fulcrum angle at 15 degrees as shown in the drawings, best seen in FIGS. 1 and 2. Therefore, it is easily mounted onto all existing elevator cylinders.

Packing 16 is shown in FIG. 3 for illustrative purposes only, and varies from elevator to elevator depending on the manufacturer. The length of spacer ring 7 is dependent on the packing mechanism used by the various makes.

In general, the packing of all rams is located in the cylinder head at the top of the cylinder. The packing is the seal which retains the oil pressure and allows the smooth ram wall to slide relatively freely through it. Generally, there is some bypass of oil through this seal. When this bypassed oil is excessive it is customary to change the packing. As common as this procedure is, it is desirable to allow easy and open access to the cylinder head. As explained previously, the present invention utilizes a three point eyelet mounting. Any one of eyelets 11 can act as a pivot to rotate brake system 1 away from main cylinder 5 to allow access for servicing. By assuring enough range of motion by having a feedback hose 49 and electrical wiring of sufficient length, the device is easily rotated for access to packing 16 without the need to disconnect electrical wiring or hydraulic connections.

National, state and local codes provide regulations for periodic testing of safety devices, so it is desirable to retest without damaging either the ram or the brake. Prototype testing to date has shown less than twenty thousandths of an inch deformation of the annealed copper at the open edges of the annealed copper bar, where the brakes meet centrally when closed, and no deformation elsewhere. Thus periodic testing is available, and the common practice of blocking the elevator to serve as a stable working platform is easily done by manually setting the brake.

Figure 6:
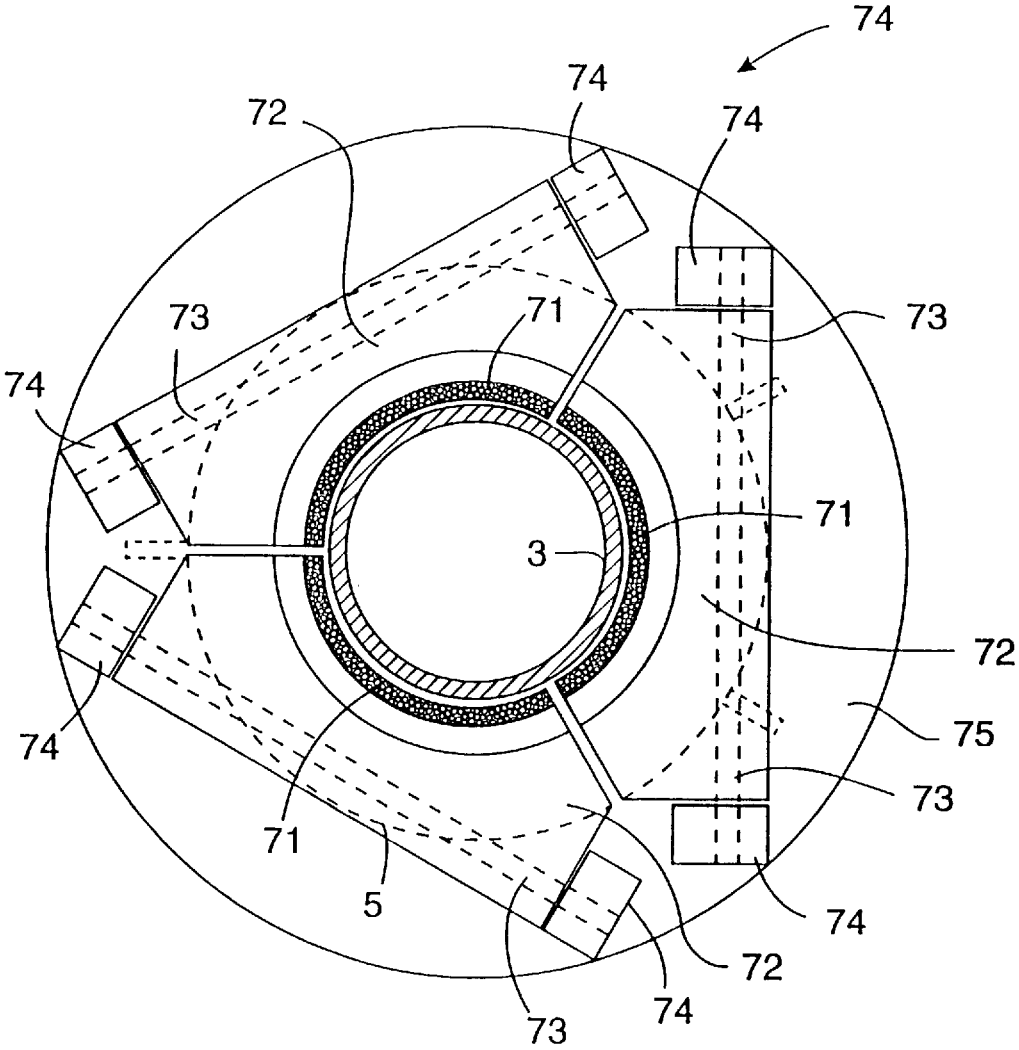
FIG. 6 is a plan view of an alternate embodiment of the brake of the present invention having multiple brake arms.

Although the previously described embodiment of the hydraulic elevator safety brake uses two brake arms, a multiplicity of brake arms could be also used. FIG. 6 shows an exemplary embodiment of the hydraulic elevator safety brake 70 of the present invention having a multiplicity of brake arms 72. In this illustrative example, the hydraulic elevator safety brake 70 has three brake arms 72. Each of the brake arms 72 has a braking surface 71 which represents a segment of a circle so that the braking surfaces 71 totally encircle the ram 3 when combined together. Each of the brake arms 72 is pivotally mounted by a hinge bolt 73 to side buttress members 74, which in turn are bolted to a mounting plate 75 which attaches to the head of the main cylinder 5 of the hydraulic elevator. As in the previously described embodiment, the braking surfaces 71 have an inner radius of curvature which is slightly less than the external radius of curvature of the ram 3, so that, when the brake arms 72 are in the actuated position, the combined braking surfaces 71 define a circle with an inner diameter which is slightly smaller than the external diameter of the ram 3. In other embodiments of the invention, the hydraulic elevator safety brake may have four or more brake arms each carrying a section of the braking surface. These sections could be equal in size, or they could be disparate, if desired. Different sized sections could be advantageous in some situations, including where the configuration of the work space makes installation or maintenance easier if a certain portion of the brake system is more articulated.

Figure 5:
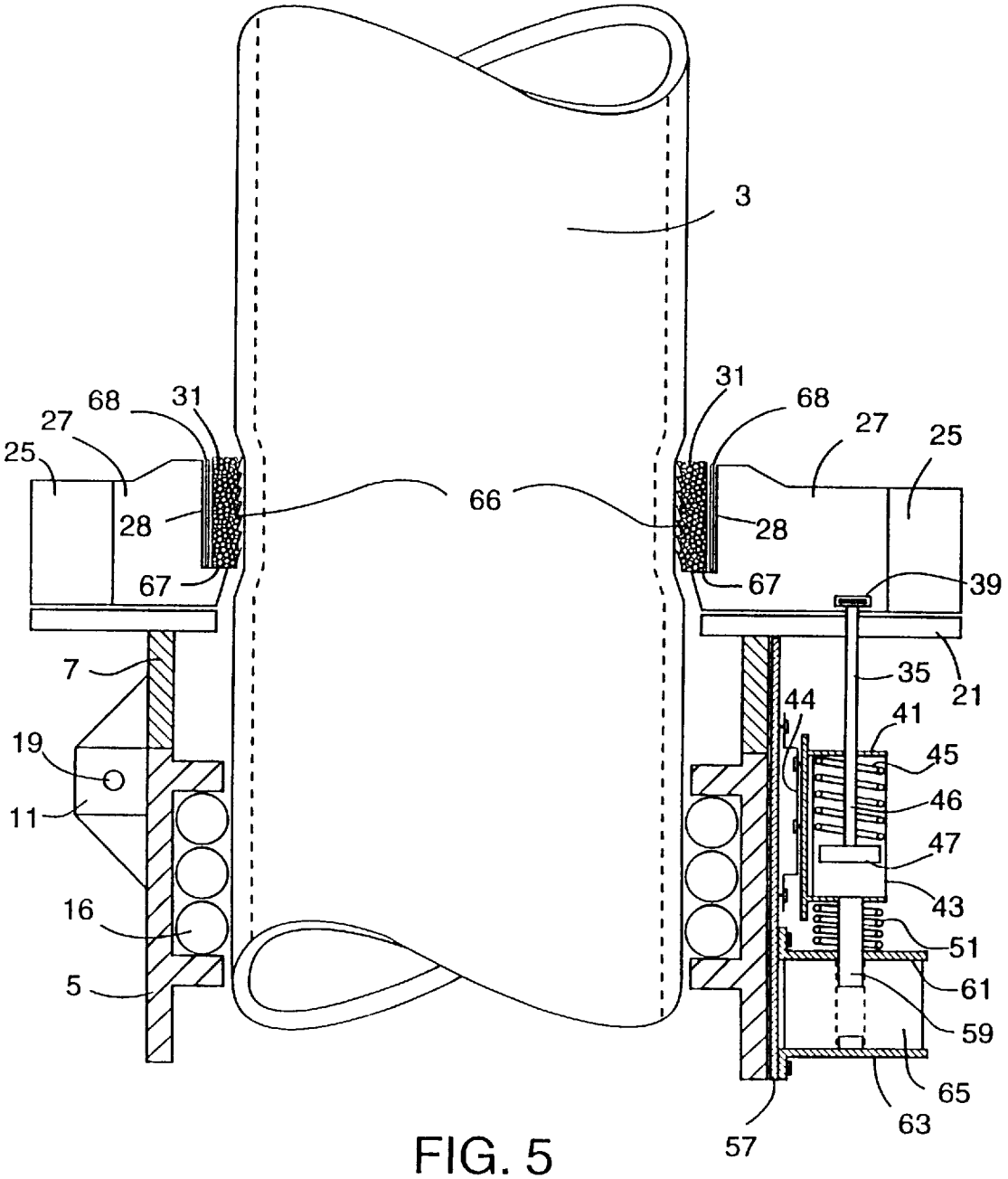
FIG. 5 is a sectional view of an alternate embodiment of the brake according to the invention.

In an alternate brake arm embodiment, shown in FIG. 5, cutting bits or teeth 66 may be fixed to the friction material mounting surface 28 of brake arms 27 in place of or in addition to accretable friction material 31. In this alternate embodiment, braking is accomplished by the teeth 66 biting into ram 3. Unlike the hourglass damage caused by the prior art, the type of damage caused by this alternate embodiment can be repaired by filling and filing the gouges.

Figure 7:
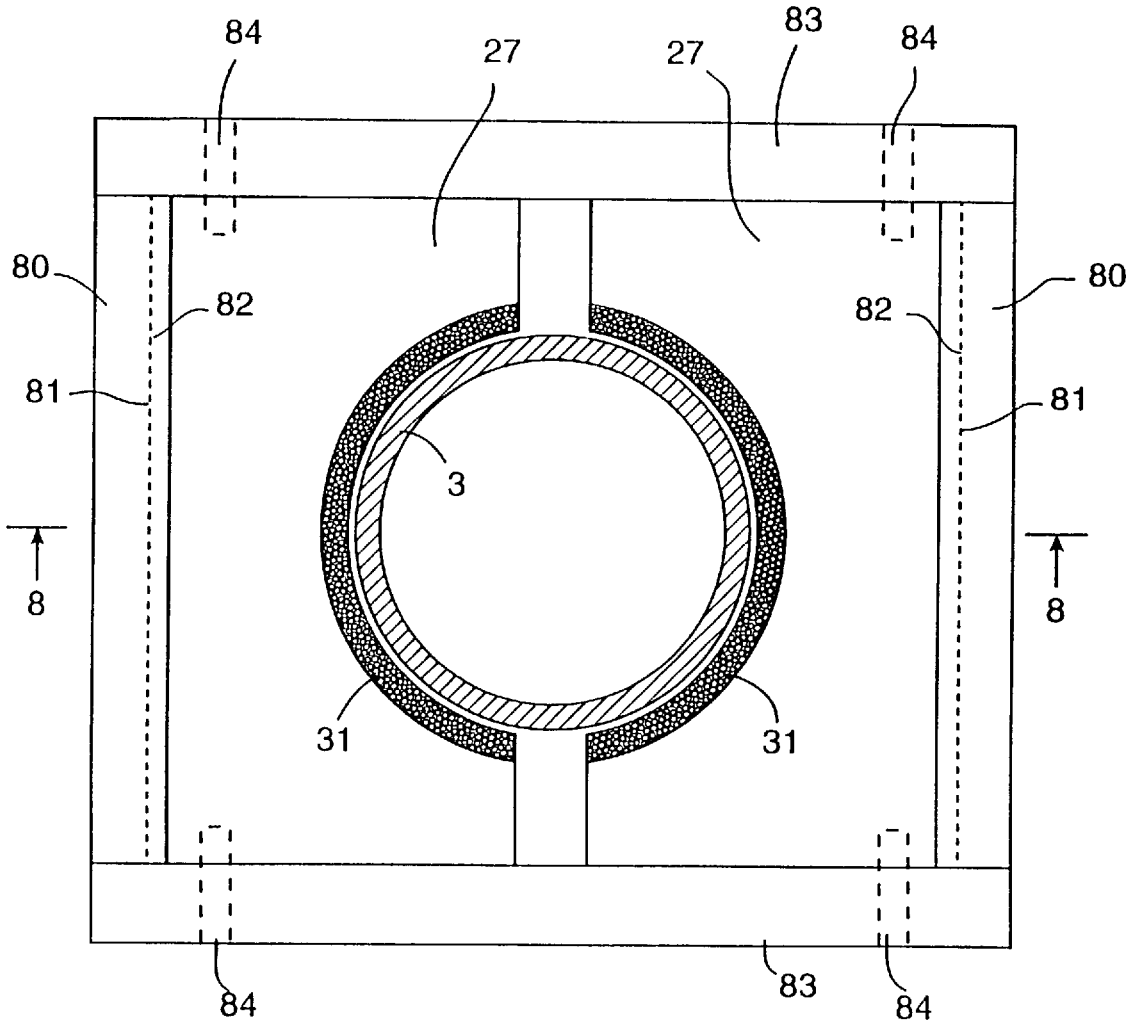
FIG. 7 is a plan view of the brake of the present invention having an alternate embodiment of the hinge mechanism.
Figure 8:
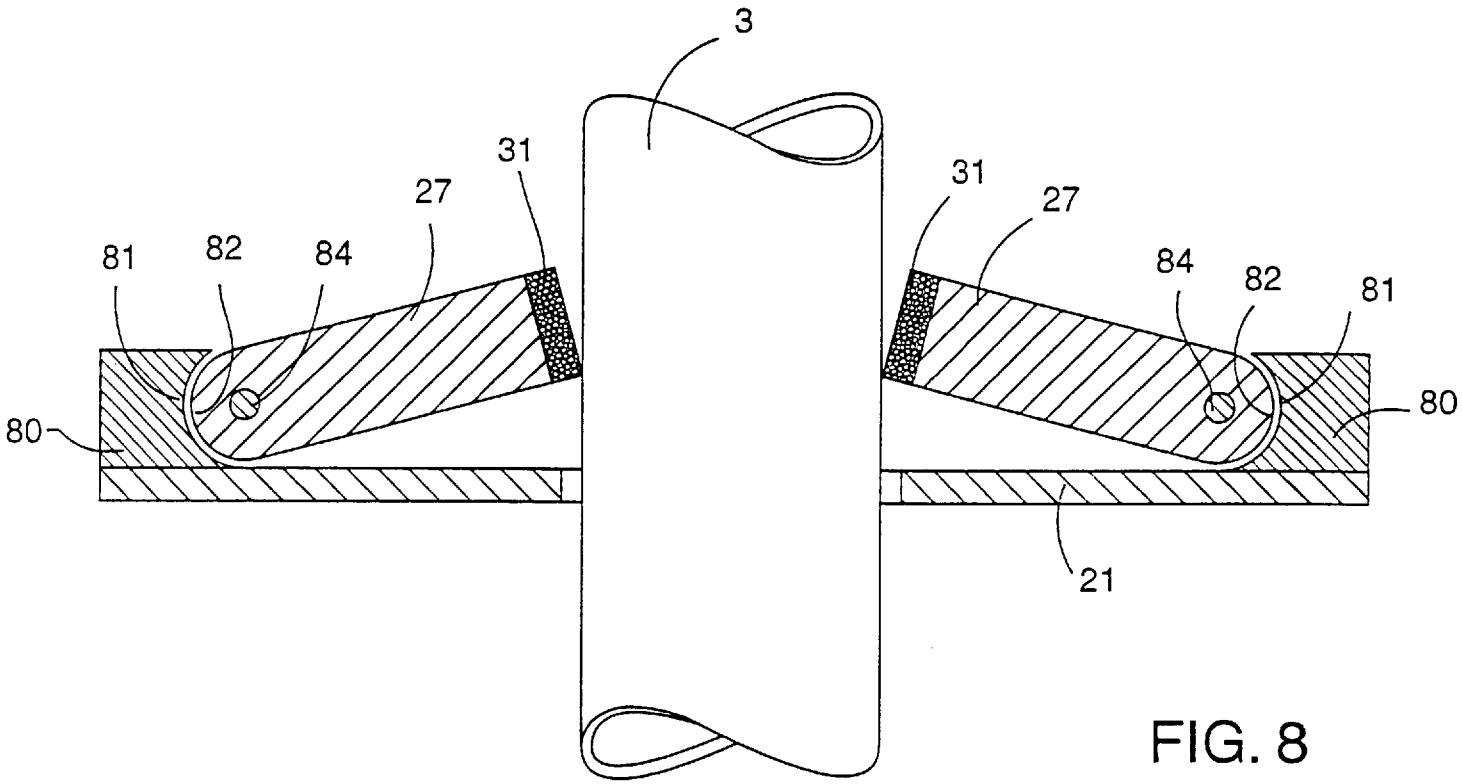
FIG. 8 is a sectional view of the brake of FIG. 7 taken along line 8—8 to show the alternate embodiment of the hinge mechanism.

Other systems for hingably mounting the brake arms 27 are possible. An embodiment of the hydraulic elevator safety brake having an alternate hinge mechanism is shown in plan view in FIG. 7 and in cross section in FIG. 8. In this alternate embodiment, the brake arms 27 are pivotally mounted between back buttress members 80 which are mounted on the base plate 21. The back buttress members 80 have a concave channel 81 which pivotally receives the rear edge 82 of the brake arms 27. The rear edges of the brake arms 27 are rounded to fit the concave channel 81 of back buttress members 80. During pivotal movement of brake arms 27, the rounded rear edges 82 of brake arms 27 slide within the concave channels 81 of back buttress members 80. When the brake arms 27 are in the actuated position, the braking force from the braking surface 31 is transferred through the brake arms 27 to the back buttress members 80. Optionally, side buttress members 83 may be provided to reinforce the back buttress members 80 and to reduce deformation under load. Hinge bolts 84 may also be provided to pivotally attach the brake arms 27 to the side buttress members 83, however, in this embodiment the greater portion of the load is preferably borne by the back buttress members 80 and rather than by the hinge bolts 84.

Figure 9:
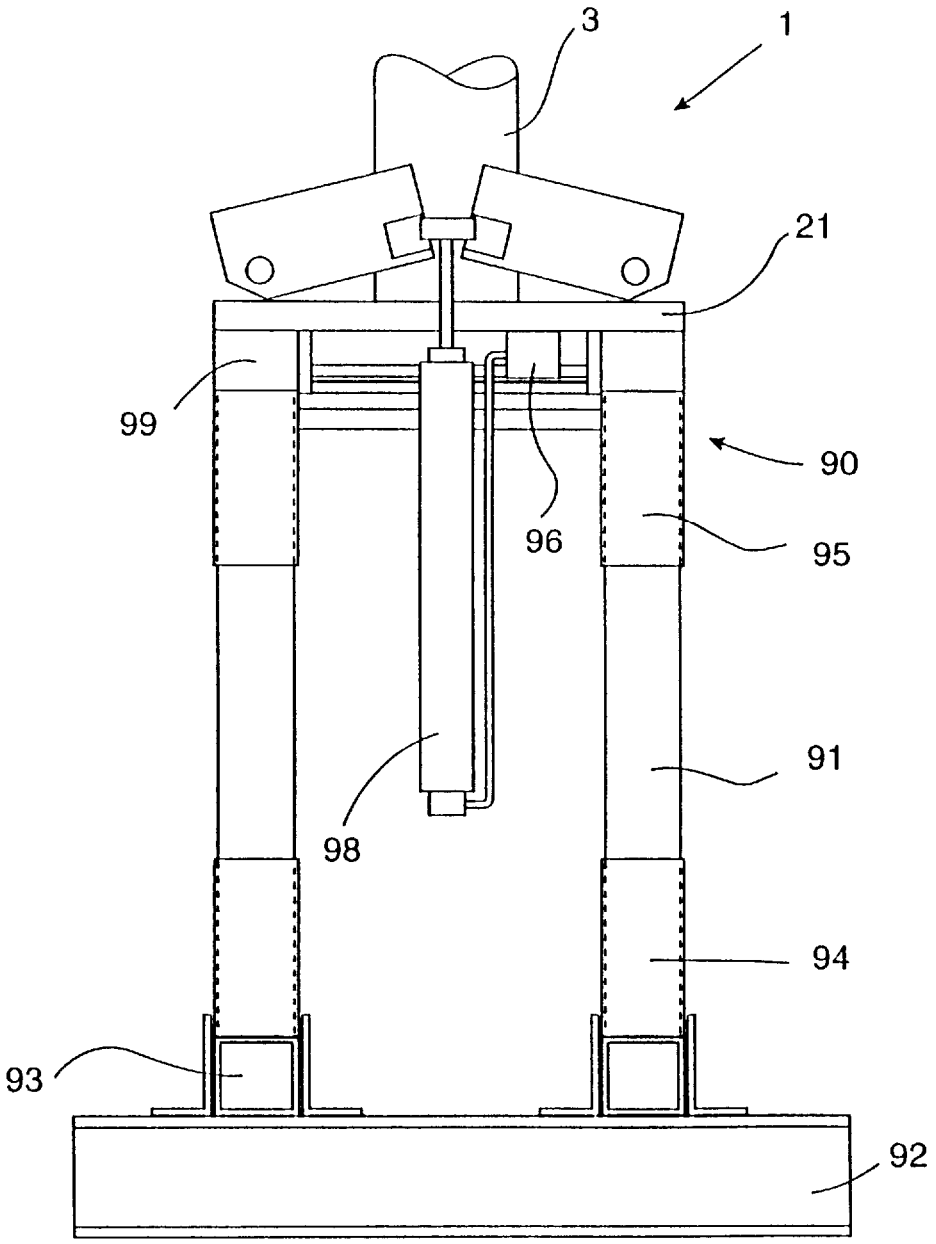
FIG. 9 shows an alternate mounting arrangement for the brake system which transfers the braking force directly to the floor of the elevator shaft.

FIG. 9 shows an alternate mounting arrangement 90 for the brake system 1 which transfers the braking force generated by the brake system 1 directly to the floor of the elevator shaft rather than to the main cylinder 5 of the elevator. The base plate 21 of the brake system 1 is mounted on four support legs 91 which extend downward toward the floor of the elevator shaft. Upper cup-shaped members 95 attach the upper ends of the support legs 91 to the base plate 21. The lower ends of the support legs 91 are attached by lower cup-shaped members 94 to support tubes 93 which distribute the braking force evenly across the footer channels 92 which rest on the floor of the elevator shaft. Additional reinforcing members 99 may be provided to rigidify the structure. The lengths of the support legs 91 may be individually adjusted by adding shims to the upper or lower ends of the support legs 91 to level the brake system 1. Braking force generated by the brake system 1 is transferred through the support legs 91 to the footer channels 92, then to the floor of the elevator shaft. FIG. 9 also shows an alternate control system for the brake system 1 having a hydraulic control cylinder 98 which is operated by a solenoid-actuated three-way valve 96. During normal operation of the elevator, the solenoid-actuated three-way valve 96 is open and hydraulic pressure within the hydraulic control cylinder 98 holds the brake system 1 in the ready position. In the event of an emergency situation, such as loss of hydraulic pressure, down overspeed or an uncontrolled downward motion of the elevator, a control signal causes solenoid-actuated three-way valve 96 to close so that a return spring within the hydraulic control cylinder 98 moves the brake system 1 into the actuated position to halt the downward motion of the elevator. This control system is also designed so that if there is a complete loss of either hydraulic pressure or electrical power, the return spring within the hydraulic control cylinder 98 will actuate the brake system 1 and halt the motion of the elevator.

The configuration of the hydraulic elevator safety brake of the present invention makes it ideally suited for retrofitting onto existing hydraulic elevators. The use of two or more pivoting brake arms which surround the elevator ram allows the safety brake to be assembled around the ram, with no need to remove the ram or to detach it from the elevator car. Prior art elevator safety brakes which use a circular collet in the brake mechanism cannot be installed onto existing elevators without removing or detaching the elevator ram. This severely limits their usefulness as a retrofit safety device for existing elevators. Alternatively, the hydraulic elevator safety brake of the present invention can also be built into new elevator installations as standard equipment. In these cases, the safety brake mechanism can be integrated into a single unit with the head of the main cylinder of the elevator.

In addition to hydraulic elevators, the elevator safety brake 1 of the present invention can also be configured for use as a safety brake for cable-actuated traction elevators. For use in this application, the ram 3 in each of the foregoing drawing figures would be replaced with the traction cable (or cables) of the cable-actuated elevator. The braking surface 31 of the brake arms 27 would be configured to frictionally engage the cable or cables of the elevator when the brake arms 27 are in the actuated position. Thus, when it is mounted in the orientation shown in the drawing figures, the brake 1 can be used to stop a falling traction elevator. The brake 1 can also be mounted in an inverted orientation for use as a safety brake to stop an uncontrolled ascent of a cable-actuated traction elevator, a phenomenon known in the elevator industry as "falling up".

I claim:

1. A hydraulic elevator safety system comprising:

a hydraulic elevator having a lifting ram cylinder, the ram cylinder having a perimeter having an external radius of curvature, and an elevator safety brake having a first lever arm and a second lever arm, each lever arm having a pivot point and an approximately semi-cylindrical braking surface, the approximately semi-cylindrical braking surface having an internal radius of curvature that is smaller than the external radius of curvature of the ram cylinder, and the pivot point being offset from the braking surface, the first and second lever arms having a first position wherein the lever arms are rotated away from the ram cylinder with the braking surfaces out of contact with the perimeter of the ram cylinder, and a second position wherein the lever arms press the braking surfaces against the perimeter of the ram cylinder to generate a braking force.

2. The elevator safety system of claim 1, wherein when the lever arms are in the second position the lever arms are approximately perpendicular to a longitudinal axis of the ram cylinder.

3. The elevator safety system of claim 2, further comprising a base plate, the base plate located below the first and second lever arms, and wherein when the first and second lever arms are in the second position the lever arms are parallel to and in contact with the base plate.

4. The elevator safety system of claim 1 wherein the braking surface is formed of an accretable material.

5. The elevator safety system of claim 1 wherein the braking surface comprises annealed copper.

6. The elevator safety system of claim 1 further comprising a pair of oppositely positioned side buttress members, the first and second lever arms being pivotally attached to the side buttress members at the pivot point, wherein, when the lever arms are in the second position, the lever arms transmit a force from the buttress member to the braking surface to generate a braking force against the ram cylinder.

7. The elevator safety system of claim 1 further comprising a detection system for detecting an emergency situation chosen from the group consisting of a loss of hydraulic pressure, an overspeed condition, and an uncontrolled motion of the ram cylinder, the detection system being in communication with an actuation means for moving the first and second lever arms from the first position to the second position when the detection system detects the emergency situation.

8. The elevator safety system of claim 3, further comprising a plurality of support legs, each support leg being coupled at a first end to the base plate.

9. A hydraulic elevator safety system comprising:

a hydraulic elevator having a lifting ram cylinder, the ram cylinder having a perimeter having an external radius of curvature, and a first lever arm and a second lever arm, each having a pivot point and an approximately semi-cylindrical braking surface having an internal radius of curvature that is smaller than the external radius of the ram cylinder, the braking surfaces comprising annealed copper, the pivot point being offset from the braking surface, the first and second lever arms having a first position wherein the lever arms are rotated away from the ram cylinder with the braking surfaces out of contact with the perimeter of the ram cylinder, and a second position wherein the lever arms press the braking surfaces against the perimeter of the ram cylinder to generate a braking force, a pair of side buttress members, the first and second lever arms being pivotally attached to the side buttress members at the pivot point, a base plate, the base plate located below the first and second lever arms, and wherein when the first and second lever arms are in the second position, the lever arms are, parallel to and in contact with the base plate, and a detection system for detecting an emergency situation, the detection system being in communication with an actuation means for moving the first and second lever arms from the first position to the second position when the detection system detects the emergency situation.

10. The elevator safety system of claim 9, further comprising a plurality of support legs, each support leg being coupled at a first end to an upper cup, each upper cup being coupled to the base plate, each support leg being coupled at a second end to a lower cup, each lower cup being coupled to support tubes.

11. A hydraulic elevator safety system comprising:

a hydraulic elevator having a lifting ram cylinder, the ram cylinder having a perimeter having an external radius of curvature, and a first lever arm and a second lever arm, each having a length, a first end and a second end, and an approximately semi-cylindrical cut-out for receiving an approximately semi-cylindrical braking surface, the approximately semi-cylindrical braking surface having an internal radius of curvature that is smaller than the external radius of the ram cylinder, the braking surfaces comprising annealed copper, the first and second lever arms are pivotable along a pivot axis that is offset from the braking surface, the first and second lever arms having a first position wherein the lever arms are rotated axially around said pivot axis away from the ram cylinder with the braking surfaces out of contact with the perimeter of the ram cylinder, and a second position wherein the lever arms press the braking surfaces against the perimeter of the ram cylinder to generate a braking force, a first pivot pin coupled to the first end of the first lever arm in alignment with the pivot axis, and a second pivot pin coupled to the second end of the second lever arm in alignment with the pivot axis, a pair of side buttress members, having pivot apertures, the pivot pins of the first and second lever arms being received within the pivot apertures of the side buttress members, a base plate, the base plate located below the first and second lever arms, and wherein, when the first and second lever arms are in the second position, the lever arms are parallel to and in contact with the base plate, a detection system for detecting an emergency situation, the detection system being in communication with an actuation means for moving the first and second lever arms from the first position to the second position when the detection system detects the emergency situation, a hydraulic actuation assembly for actuating the elevator safety system coupled to the detection system, and a support structure comprising a plurality of support legs, each support leg being coupled at a first end to an upper cup, each upper cup being coupled to the base plate, each support leg being coupled at a second end to a lower cup, each lower cup being coupled to support tubes.

* * * * *